United States Patent [19]

May et al.

[11] 3,964,590

[45] June 22, 1976

[54] PARKING METER WITH AUTOMATIC READING MEANS

[75] Inventors: Kenneth D. May, Buffalo Grove; Elmer E. Dodson; Claude C. Cohee, both of Des Plaines, all of Ill.

[73] Assignee: Qonaar Corporation, Elk Grove Village, Ill.

[22] Filed: May 16, 1975

[21] Appl. No.: 578,153

[52] U.S. Cl. ..... 194/83; 194/DIG. 22

[51] Int. Cl.[2] ..... G07F 5/00

[58] Field of Search ..... 194/72, 83, DIG. 21, 194/DIG. 22

[56] References Cited

UNITED STATES PATENTS

| | | | |
|---|---|---|---|
| 2,927,675 | 3/1960 | Iapaore | 194/DIG. 22 |
| 3,027,866 | 4/1962 | Sollenberger | 194/DIG. 22 |
| 3,782,519 | 1/1974 | Zajac | 194/DIG. 22 |
| 3,828,907 | 8/1974 | Bock | 194/DIG. 22 |

*Primary Examiner*—Allen N. Knowles

*Attorney, Agent, or Firm*—McDougall, Hersh & Scott

[57] ABSTRACT

A meter construction such as a parking meter wherein time is purchased upon insertion of coins into the meter. A time indicator means is movable over a dial face for displaying the amount of time purchased. Cam follower means are connected to the indicator means so that the indicator means is held in displaying position after purchase of time when the follower is held in engagement with a cam connected to the clock mechanism. Once time has been purchased, and the follower is not manually held in engagement with the cam, the time indicator disappears from view. Manually operated means are provided for moving the indicator and associated cam follower so that if the previous purchaser or a new purchaser arrives at the meter, it will be possible for either one to determine the amount of previously purchased time remaining on the meter. This arrangement leads to more efficient use of meters from a revenue collection standpoint, users are always able to get an accurate time reading, and traffic congestion, energy consumption, and air pollution problems are better controlled.

13 Claims, 9 Drawing Figures

PARKING METER WITH AUTOMATIC READING MEANS

This invention relates to parking meters and similar coin controlled constructions which are utilized for the purchase of time. Parking meters comprise typical applications for such structures in that the amount of time purchased provides a driver with a legal period for the use of a parking space for an automobile.

In standard parking meter constructions, indicator means such as a pointer movable over a dial face are utilized for displaying the amount of time purchased. These indicator means permit the user to insert one or more coins and to then verify that the correct amount of time is displayed on the meter.

A drawback to the arrangement described results when a purchaser removes his automobile from a parking place before the expiration of the time purchased. Since the indicator means still displays the time remaining, one or more additional automobiles can use the parking space without any payment. This, of course, results in a loss of potential revenue for the municipality or other institution responsible for the parking meters.

Attempts have been made to overcome this drawback by providing meters which indicate that purchased time is available but which will not display the exact amount of time available. An example of such a meter construction is found in Sollenberger U.S. Pat. No. 3,027,866, this meter being provided with an indicator having a single visible position. When purchased time remains on the meter, the indicator will always be in this single position. If the parking space is unoccupied, a new user will know that some time remains, however, he cannot assume that more than a few minutes is available and, therefore, the tendency is to insert more money.

Meters of the type described in the Sollenberger patent are somewhat objectionable to the public. Thus, the person inserting coins has no indication that a certain amount of time has been purchased, and this leads to doubt about the reliability of the meter. For example, even though a purchaser may insert a quarter for two hours parking time, he is not given any indication which will assure him that he has purchased that amount of time.

In Zajac U.S. Pat. No. 3,782,519, a structure is described wherein the amount of purchased time is displayed on the meter when the meter is operated whereby the purchaser is satisfied that the meter is operating properly and the purchaser will then depart. After an elapse of time —preferably a few minutes— the indicator is caused to return to the zero time position so that one approaching later on cannot determine the time remaining and must make a further deposit to insure valid parking. Meters of the type covered by the Zajac patent have been criticized by certain consumer organizations since the purchaser, or some other person, cannot determine the time on the meter after return of the indicator to the zero time position.

It is a general object of this invention to provide an improved meter construction which will increase the revenue made available with standard meter designs while enabling one to readily determine the actual time remaining.

It is a more specific object of this invention to provide an improved meter construction which employs an indicator means whereby the amount of time purchased will be displayed for the person inserting coins in the meter, which thereafter indicates that some undisplayed amount of purchased time is available, and which includes manually operated means for displaying the exact amount of purchased time remaining at any given time.

These and other objects of this invention will appear hereinafter and for purposes of illustration, but not of limitation, specific embodiments of the invention are shown in the accompanying drawings in which.

Figure 8:
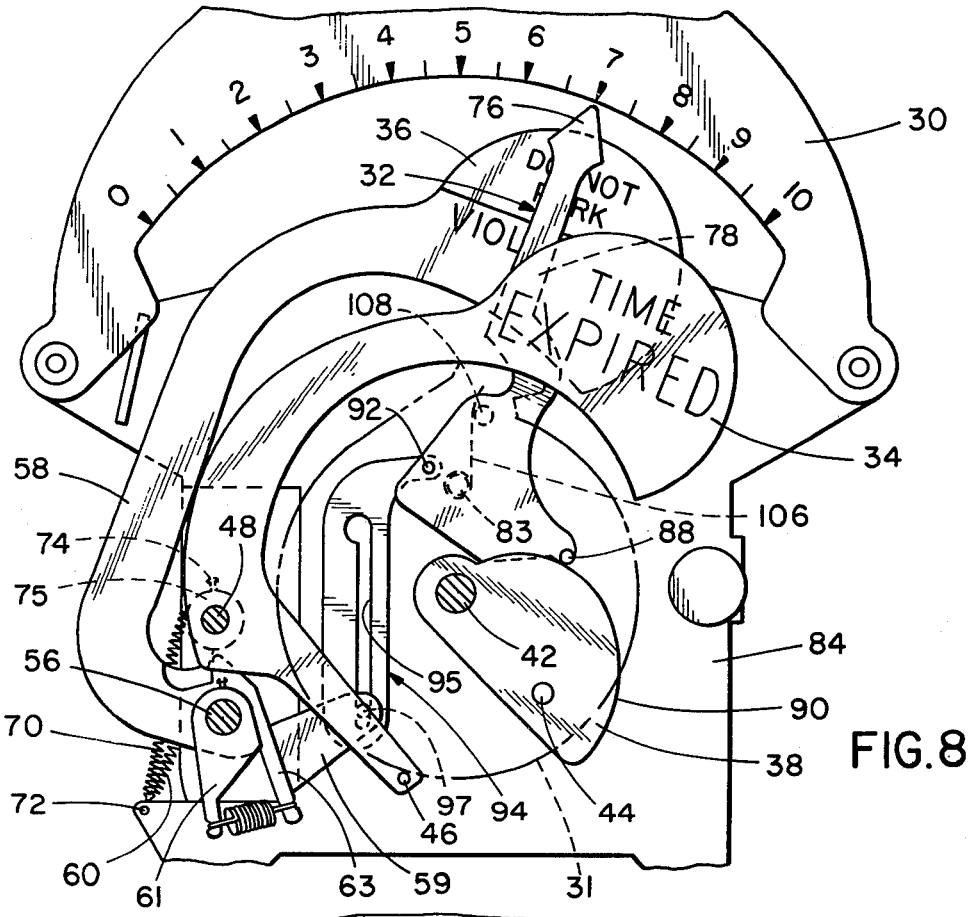
Figure 9:
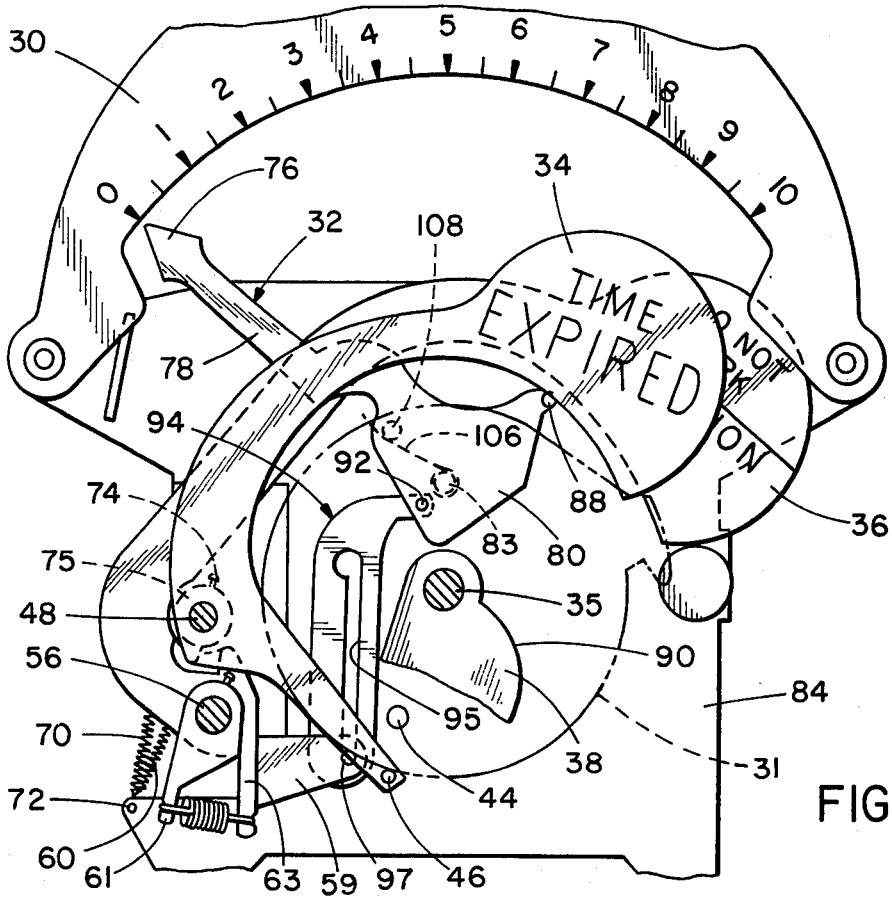

FIG. 8 is an enlarged vertical sectional view in elevation illustrating portions of the meter construction in the positions occupied with additional purchased time on the meter and with the indicator in the display position; and, FIG. 9 is an enlarged vertical sectional view in elevation illustrating portions of the meter construction in the positions occupied with purchased time on the meter and with the indicator out of display position.

The subject matter of this invention generally relates to a meter construction wherein purchased time is obtained upon the insertion of a coin. The coin is received by means which serve to locate the indicator means for displaying the time purchased. These indicator means are tied to operating means which move the indicator means out of indicating position when the time setting handle or other means is released. This arrangement, therefore, permits the initial purchaser to observe the amount of time purchased both during the time setting operation, and subsequently if this initial purchaser should return to the parking place to determine the time remaining. Moreover, if the initial purchaser should leave the parking space with time still remaining, a subsequent purchaser can determine the amount of time remaining by turning the time setting handle.

In the case of parking meters, this arrangement encourages the subsequent user of a parking space to park and get out of his car since this is the only way that this subsequent user can determine the amount of time which he will have available for legal parking. Once parked, the subsequent user will insert more money, if necessary, and he will not be likely to look for another space having more unelapsed time on the meter. Accordingly, there is a reduced tendency to "cruise" around looking for meters with substantial amounts of time available. In addition to increasing revenue, traffic congestion is reduced, and there is a not insignificant reduction in fuel use and air pollution.

The structure of the invention specifically comprises an indicator having an associated cam follower. This cam follower is adapted to engage a cam element which is connected to the timing mechanism. The engagement occurs as time is being wound on the meter with the manually operated time winding means serving to drive the indicator cam follower into engagement with the cam element. When the manual operating means is released by the purchaser of time, the cam follower is automatically removed from contact with the cam which results in movement of the indicator to a position, for example the zero time position or out of view, such that an accurate time display is not available. The purchaser of the time (or any subsequent person) can, however, determine the amount of time purchased by simply operating the manual operating means.

If the purchaser of time returns and leaves the parking space before the meter time has expired, another motorist can see from his car that time is available on the meter. This condition is obtained by the use of flags. In particular, the meter may be equipped with what will be hereinafter called a "primary" flag, this flag bearing such words as "time expired", the primary flag being displayed when all purchased time has expired. A "secondary" flag may also be used, this flag bearing the term "violation" or similar words to indicate that the meter is being improperly used, for example, when a motorist only gives a partial wind after inserting a coin.

With neither the primary nor the secondary flag on display, a motorist will know that there is some time on the meter; however, the amount of time cannot be visually determined. In view of the inability to determine the amount of previously purchased time remaining, the motorist must park his car, leave the car and then manually move the indicator to the time display position to determine that amount.

The structure of the invention thus provides a means for determining the amount of purchased time remaining so that the meter cannot be criticized as being unfair. Thus, a full disclosure of what has been purchased is always available, and consumer protection laws are not violated. On the other hand, the meter tends to eliminate the problems created by motorists driving in congested traffic areas searching for meters with an adequate amount of time remaining for their purposes. With this construction, the motorist cannot determine the amount of time available until after parking and leaving the car, and there will be little temptation to search for meters with the most time remaining. The result is that traffic congestion is somewhat alleviated while parking revenues will increase because of the fact that meters with little time remaining will require a deposit of additional money when with conventional meters, meters with more time remaining would instead be used.

One additional advantage of the invention is that the above results can be accomplished without necessity for major modifications of an existing meter design. As illustrated in the accompanying drawings, a meter construction 10 of the general type described in Sollenberger U.S. Pat. No. 2,603,288 may be modified to achieve the structure of this invention. This meter includes a front wall 12 defining coin passages 14. An operating handle 16 is rotatably positioned on the front wall, and a coin carrier 18 is located immediately behind the front wall. This coin carrier is secured for rotation with shaft 20 and the handle 16 is connected to the shaft for achieving this rotation. Slots 22 are defined by the coin carrier, and these slots are normally aligned with the passages 14 so that coins inserted in the passages will be received within the coin carrier.

In accordance with the description set forth in U.S. Pat. No. 2,603,288, the timing mechanism of a meter is set when a coin is positioned within the coin carrier 18, and when the handle 16 is rotated. The time setting operation involves the engagement of a pawl associated with the coin carrier with one of the teeth 24 formed on winding ring 26. This winding ring is tied to the shaft of a clock mechanism for accomplishing the winding action necessary for setting the clock. A plurality of ratchet teeth 28 are positioned around the winding ring, and these ratchet teeth are engageable with a separate pawl for preventing return movement of the coin carrier as long as a coin is positioned therein.

Figure 1:
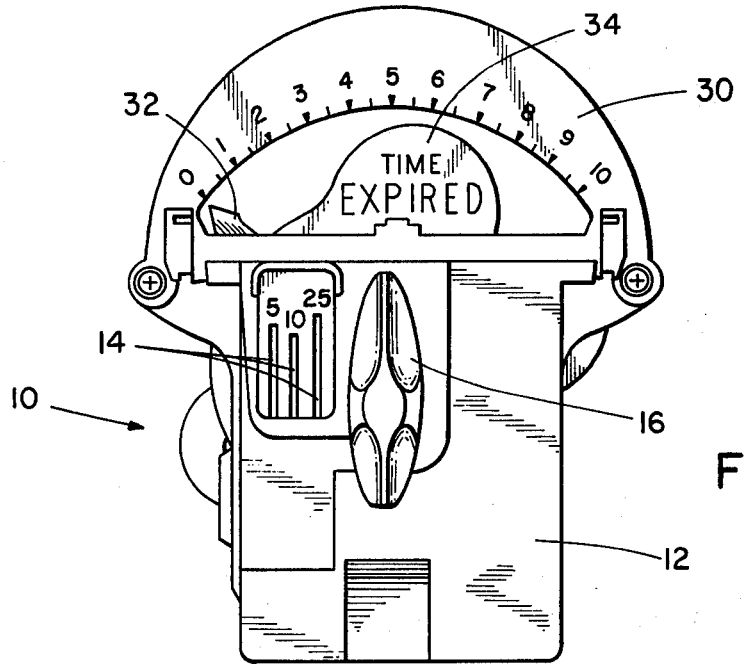
FIG. 1 is a front elevational view of a meter mechanism located outside the meter housing.

The meter construction also includes an indicator dial 30 displaying increments of time. A pointer 32 is adapted to be positioned by mechanisms to be described for purposes of indicating to the purchaser of time the amount of time wound on the timing mechanism. The meter construction also includes a primary flag 34 which, in the position shown in FIGS. 1, 2 and 6, tells the purchaser that there is no time on the meter. A secondary flag 36 is adapted to be moved into display position when the handle 16 is in an intermediate position to prevent improper use of the meter as explained in the Sollenberger patent.

Figure 2:
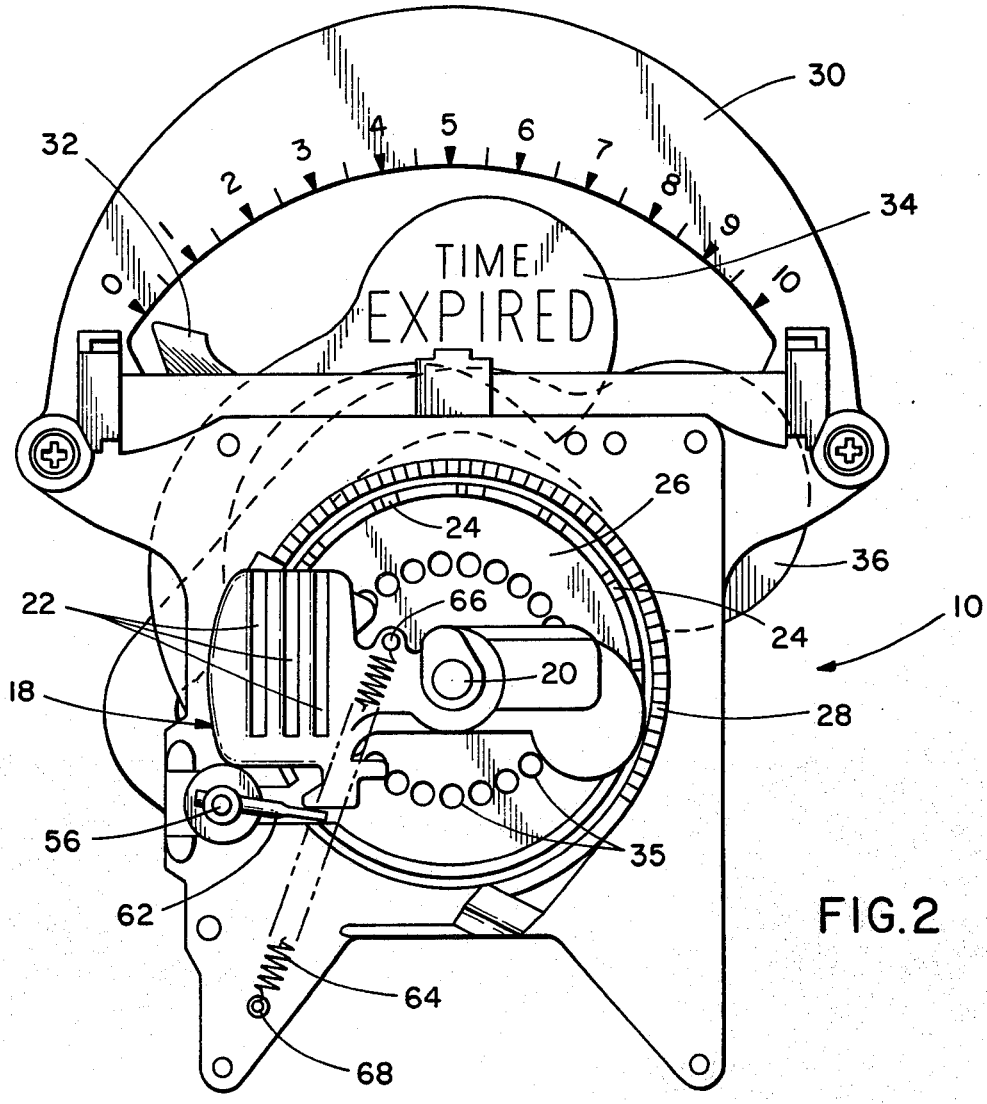
FIG. 2 is an enlarged vertical sectional view in elevation of the mechanism.

The winding ring 26 is tied to the clock mechanism through a winding disc 31 (FIGS. 3–9). Fasteners, such as rivets, are employed for accomplishing the connection between these members so that rotation of the winding ring results in corresponding rotation of the disc 31. As shown in FIG. 2, a plurality of openings 35 are formed in the winding ring so that the relative position of the ring and disc can be changed depending upon the particular meter application involved. Thus, the relative positions of these members can be used to regulate the degree of wind for a given coin which accounts for the provision of different relative positions.

Figure 3:
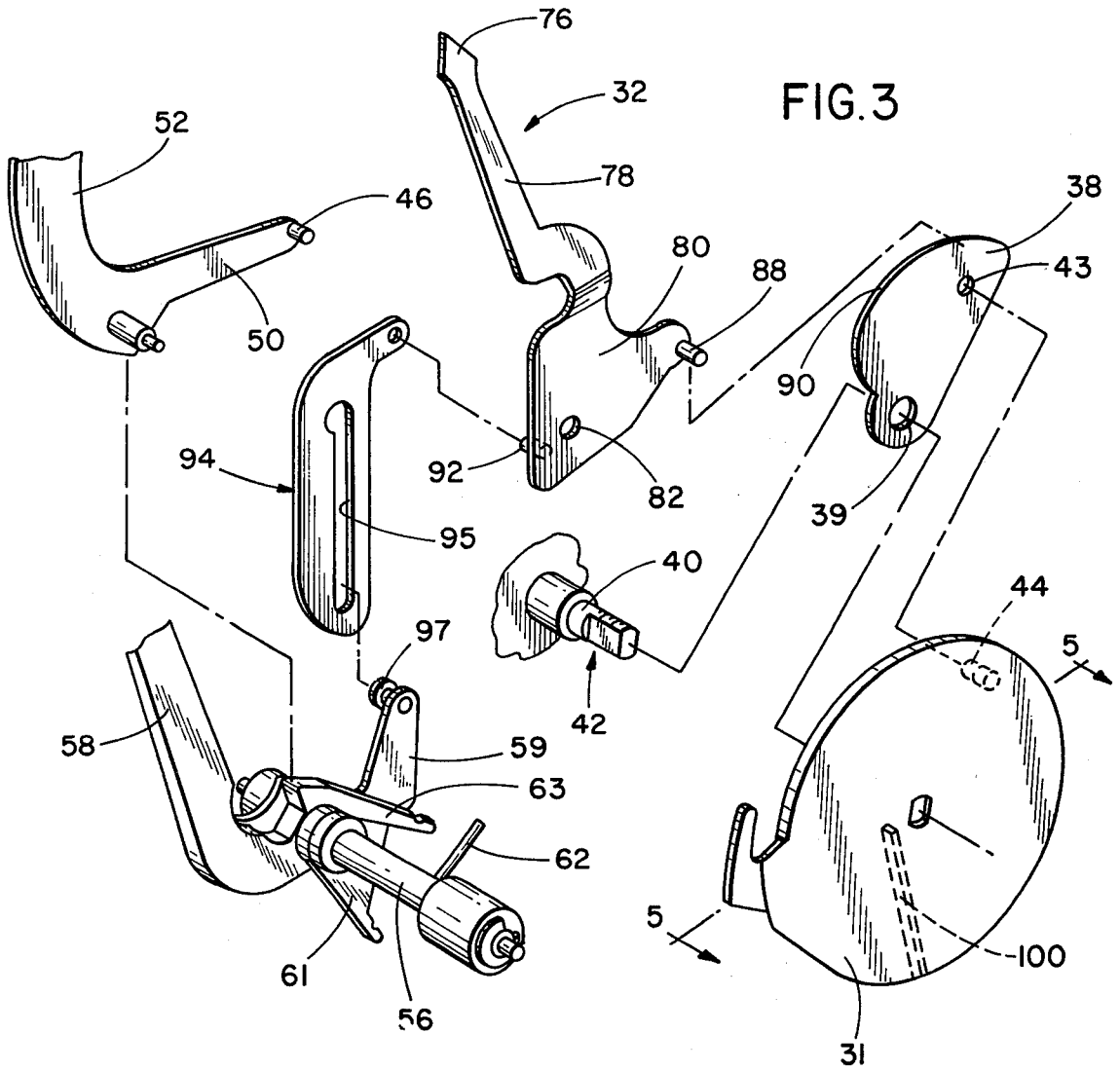
FIG. 3 is an exploded view in perspective of various elements of the construction of the invention.
Figure 4:
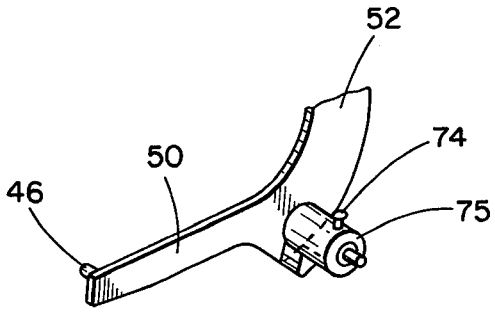
FIG. 4 is a fragmentary perspective view illustrating the end section of a time expired flag utilized in the construction.

A cam plate 38 is supported on the disc 31 for movement therewith. As shown in FIG. 3, the cam plate includes an opening 39, which receives a shaft portion 40 of shaft 42. This shaft supports at one end the winding ring 26 and extends through the disc 31 and cam plate 38 to the clock mechanism of the meter. Accordingly, the winding ring, disc, cam plate and clock mechanism are all simultaneously moved. The position of the cam plate relative to the disc is controlled by means of a post 44 which extends through a second opening 43 positioned in spaced relationship relative to the axis of the cam plate. The relative position of the cam plate on the disc affects the operation of the indicator needle 32 during a time purchase operation and, as will be explained, when the handle is rotated for display purposes. Different positions for the post 44 may, therefore, be selected depending upon the operation desired. The configuration of the cam plate can also be varied for purposes of varying the meter operation.

The disc 31 defines a rim 45 which provides a bearing surface for a follower 46 defined by the primary flag 34. This flag is pivotally connected to the meter housing at 48, and a short arm portion 50 of the flag supports the follower 46 which may take the form of a pin secured in an appropriate opening defined by the arm 50. The primary flag is positioned at the end of the longer arm 52, and this arm is curved to accommodate the other mechanisms illustrated.

The meter housing also supports a secondary flag 36 which is secured to pivoting rod 56. The rod 56 extends from the front wall of the meter housing to the rear wall behind the pivotal connection of the arm 58 which supports the flag 36. A first spring 60 normally urges the arm 58 in a counterclockwise direction relative to the positions shown in FIGS. 6–9. The flag 36 is, however, normally maintained in the depressed position shown in FIG. 6 due to the engagement between the coin carrier 18 and pin 62 carried by shaft 56. The coin carrier is normally urged in a counterclockwise direction by spring 64 which has one end attached at 66 to the coin carrier and the other end attached at 68 to the front wall of the housing (FIG. 2).

The spring 64 applies a superior force relative to the spring 60. When the coin carrier 18 is manually rotated, the engagement with pin 62 is removed whereby the shaft 56 will rotate in response to the action of spring 60. This operation moves element 61 to drive the end section 63 of flag 36 counterclockwise thereby raising the secondary flag which prevents a driver from partially rotating the coin carrier in an attempt to confuse law enforcement officials. The function of the secondary flag is more fully described in Sollenberger U.S. Pat. No. 2,603,288.

An additional spring 70 is also attached at one end to the meter housing at 72 with the other end being attached to a pin 74 carried on sleeve 75 attached to the primary flag at the pivot axis 48. The spring 70 urges the primary flag in the counterclockwise direction whereby this flag is normally maintained in the raised or visible position.

The indicator needle 32 is illustrated in detail in FIG. 3. This needle includes a pointer 76 at one end of arm 78 with the other end of the arm being integral with the support 80. This support includes an opening 82 which enables pivotal attachment of the pointer to pivot pin 83 positioned on the intermediate wall 84 of the meter housing. A cam follower in the form of pin 88 extends outwardly from the support 80 and this cam follower is adapted to engage the periphery 90 of the cam 38. An additional stud 92 is formed on the support 80, and this stud pivotally supports link 94. The link 94 defines an elongated slot 95 which receives a pin 97 carried by the arm portion 59 of flag 36.

In the operation of the described structure, coins are inserted through slots 14 and received in slots 22 of the coin carrier 18. Upon rotation of the coin carrier by means of handle 16, pawls carried by the coin carrier engage teeth 24 of the winding ring 26 thereby winding the clock mechanism.

Figure 5:
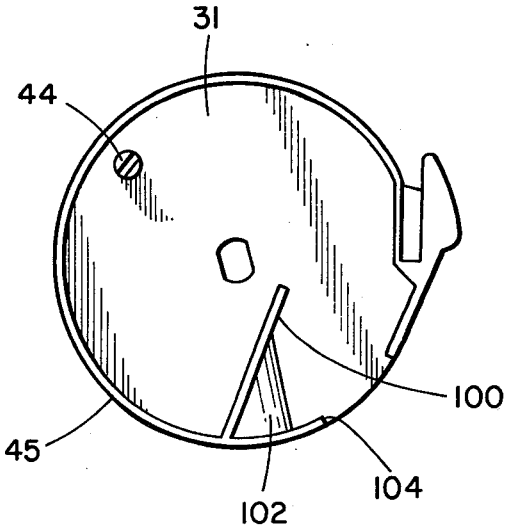
FIG. 5 is a plan view of a winding disc utilized in the construction.
Figure 6:
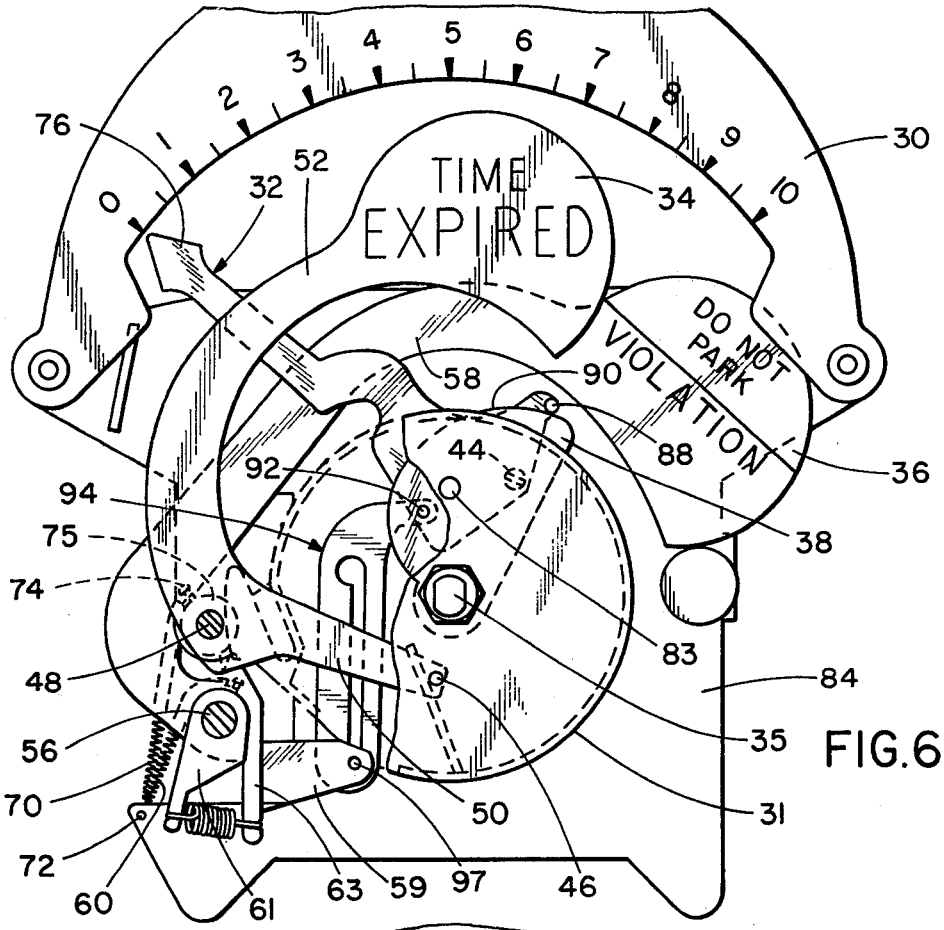
FIG. 6 is an enlarged vertical sectional view in elevation illustrating portions of the meter construction in the positions occupied with no purchased time on the meter.

FIG. 6 illustrates the condition of the elements of the construction prior to the winding just described. As soon as the coin carrier begins movement in the manner described, the flag 36 shown in FIG. 6 is moved to a display position since the engagement between the coin carrier and the pin 62 is removed. When the time winding operation begins, the winding disc 31 begins movement in the clockwise direction whereby the pin 46 at the end of primary flag 34 moves radially outwardly along the wall 100 formed on the disc. As shown in FIG. 5, a ramp 102 is provided on the disc for purposes of driving the pin and associated arm 50 outwardly so that the pin 46 eventually moves beyond the edge of the disc. This operation places the primary flag in the position shown in FIG. 7. The spring 70 normally urges the flag against the rim 45 of the disc, and this engagement is maintained whenever purchased time remains on the meter. When time has expired, the disc 31 will have moved to the extent that the pin 46 reaches the edge 104 of the rim at which time the spring 70 returns the pin 46 to the position of FIG. 6 and again moves the primary flag to the display position.

The winding of time on the meter changes the position of cam plate 38 since this cam plate is tied to the shaft 42. The indicator 32 is pivoted in the course of a winding operation through the action of spring 106 which has one end wound around pivot pin 83 with the spring then extending outwardly into engagement with pin 108 (FIG. 8). This spring action normally urges the indicator in the clockwise direction to thereby provide for engagement of the pin 88 with the edge 90 of cam plate 38. The spring 106 is a light spring so that this counterclockwise action is only developed when the indicator is otherwise substantially free for movement.

Figure 7:
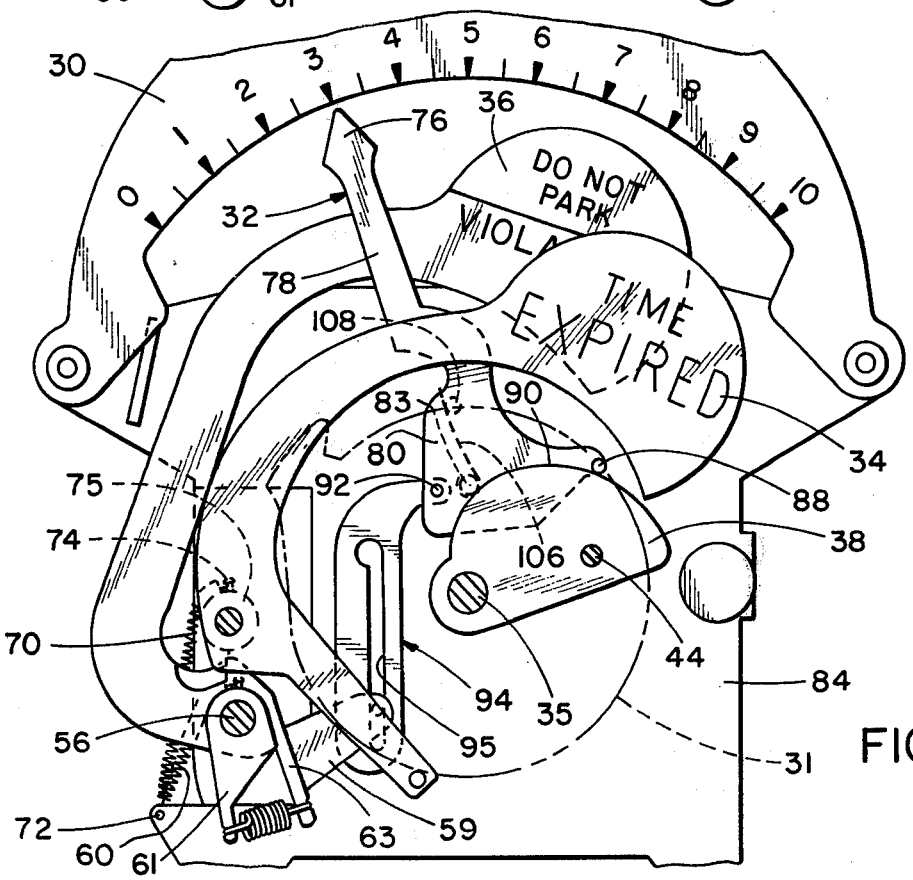
FIG. 7 is an enlarged vertical sectional view in elevation illustrating portions of the meter construction in the positions occupied with purchased time in the meter and with the indicator moved to a display position.

After achieving the condition illustrated in FIG. 7, the handle 16 is released by the motorist whereby the secondary flag 36 will drop down upon engagement of the coin carrier with the pin 62. This achieves the condition shown in FIG. 9, and it will be noted that the indicator 32 has now moved to the zero position. This action is achieved since the movement of the pin 62 by the coin carrier rotates shaft 56 whereby arm 59 moves in the clockwise direction. Movement is then transmitted to link 94 thereby pulling the indicator 32 to the zero position in opposition to the light spring 106. The cam plate 38, of course, remains in the same position; however, the pin 88 of the indicator is now separated from the cam surface 90.

In the event that the motorist wishes to purchase more time than the 3 hours illustrated in FIG. 7, an additional coin or coins may be inserted. When the coin carrier is manually moved in the manner described, the cam plate 38 is rotated an additional amount in the clockwise direction to achieve, for example, a purchase of 7 hours of time as shown in FIG. 8. FIG. 9 illustrates the cam element 38 in the maximum position of rotation whereby 10 hours of time is purchased. In all instances where some purchased time is on the meter, release of the handle 16 immediately results in return of the indicator to the zero position with the flags 34 and 36 being out of the display position as shown in FIG. 9.

When a motorist sees a meter in the condition of FIG. 9, he will be aware that some time remains on the meter; however, he cannot determine the exact amount of time unless he parks the car and manually operates the handle 16. When the handle is rotated, the coin carrier 18 releases the pin 62 and there is then no resistance offered to spring 106 associated with the indicator. The indicator thus moves immediately to a display position with the amount of time displayed being determined by the position of cam plate 38. Since the cam plate 38 is continuously moving as the clock mechanism runs down, the time displayed by the indicator 32 will always be the time remaining on the meter.

It will be apparent that in many instances, a motorist will find that only a small amount of time remains. Rather than getting back into the car to search for a meter with more time, the motorist will be inclined to purchase additional time. As indicated, the mechanism described eliminates the tendency of motorists to drive around looking for meters with more time remaining, and the arrangement results in revenue increases in addition to avoiding some traffic problems. This is accomplished while at the same time providing the public with a means for determining the amount of purchased time remaining on the meter.

In addition to the features described, the described structure has the advantage that it can be provided without any extensive redesign of the meters. It will be appreciated, however, that the use of structures other than the one specifically described is contemplated for achieving the results of the invention. Thus, the provision of a secondary flag is not required, and either no flag or some other type of visual display could be used. It will also be appreciated that means other than the handle 16 could be used for releasing the restraining force on the indicator when a reading is desired. Such means could comprise, for example, a pushbutton, a rod, or lever means operatively connected to the indicator through a suitable link. The link may comprise a member as illustrated, a cable, or some equivalent means. The pushbutton or the like will release the indicator upon actuation and with a spring loaded indicator as illustrated, the indicator will then automatically be driven to indicating position. Alternatively, the indicator could be spring loaded to the non-display position in which case the manually operated handle, the pushbutton, or the like would positively drive the indicator into the accurate time display position.

It will be understood that various changes and modifications may be made in the above described construction which provide the characteristics of the invention without departing from the spirit thereof particularly as defined in the following claims.

That which is claimed is:

1. In a coin controlled meter construction including coin receiving means, manually controlled drive means for said receiving means, a movable cam adapted to be drivingly engaged by said receiving means, indicator means for displaying the time purchased, and a cam follower associated with said indicator means, said cam defining a surface for engagement with said cam follower, movement of said cam by said receiving means selectively positioning the cam depending upon the amount of time purchased, the improvement comprising a link having one end operatively connected to said manually controlled drive means and the other end connected to said indicator means, first means normally urging said manually controlled drive means in one direction whereby said link pulls the cam follower of said indicator means out of engagement with said surface to thereby prevent accurate reading of the time remaining on said meter, second means normally urging the cam follower of said indicator means into engagement with said cam surface, said first means applying a greater force than said second means, and wherein operation of said manually controlled drive means overcomes said first means whereby said indicator means is temporarily moved by said second means to a position for accurately reading the time remaining on the meter.

2. A construction in accordance with claim 1 wherein said first and second means comprise springs, the spring comprising said first means being attached to said coin receiving means for normally holding the coin receiving means in position for receiving coins.

3. A construction in accordance with claim 1 including a display flag, means connecting the flag to said manually controlled drive means whereby the flag is driven to a display position when said manually controlled drive means operates to move said coin receiving means, said link being attached to said flag and said indicator means being connected to said manually controlled drive means by reason of said attachment of said link to said flag, said flag being in display position when said indicator means is temporarily moved to an accurate time display position.

4. A construction in accordance with claim 3 wherein said link defines an elongated slot, the means connecting said flag with said link comprising a pin carried by said flag and received in said slot whereby the flag is movable relative to said link.

5. In a coin controlled meter construction including coin receiving means, drive means for said receiving means, indicator means for displaying the time purchased, and positioning means for engagement by said indicator means whereby the indicator means will display the time purchased, said positioning means being drivingly connected to said receiving means, movement of said positioning means by said receiving means selectively locating the positioning means depending upon the amount of time purchased, the improvement comprising a control means for said indicator means, a link having one end operatively connected to said control means and the other end connected to said indicator means, first means normally urging said control means in one direction whereby said link pulls the indicator means out of engagement with said positioning means to thereby prevent accurate reading of the time remaining on said meter, second means normally urging the indicator means into engagement with said positioning means, said first means applying a greater force than said second means, and wherein operation of said control means overcomes said first means whereby said indicator means is temporarily moved by said second means to a position for accurately reading the time remaining on the meter.

6. A construction in accordance with claim 5 wherein said drive means are utilized as said control means.

7. A construction in accordance with claim 5 wherein said positioning means comprises a cam, said indicator means including a cam follower for engagement with the surface of said cam.

8. A construction in accordance with claim 6 wherein said first and second means comprise springs, the spring comprising said first means being attached to said coin receiving means for normally holding the coin receiving means in position for receiving coins.

9. A construction in accordance with claim 8 including a display flag, means connecting the flag to said control means whereby the flag is driven to a display position when said control means operates to move said coin receiving means, said link having said one end attached to said flag, said indicator means being connected to said control means by reason of said attachment of said link to said flag, said flag being in display position when said indicator means is temporarily moved to an accurate time display position.

10. A construction in accordance with claim 9 wherein said link defines an elongated slot, the means connecting said flag with said link comprising a pin carried by said flag and received in said slot whereby the flag is movable relative to said link.

11. In a coin controlled meter construction including coin receiving means, drive means for said receiving means, indicator means for displaying the time purchased, and positioning means for engagement by said indicator means whereby the indicator means will display the time purchased, said positioning means being drivingly connected to said receiving means, movement of said positioning means by said receiving means selectively locating the positioning means depending upon the amount of time purchased, the improvement comprising a control means for said indicator means, a link having one end operatively connected to said control means and the other end connected to said indicator means, first means normally urging the indicator means out of engagement with said positioning means to thereby prevent accurate reading of the time remaining on said meter, said control means through said link being adapted to urge the indicator means into engagement with said positioning means, said control means applying a greater force than said first means, and wherein operation of said control means overcomes said first means whereby said indicator means is temporarily moved by said control means to a position for accurately reading the time remaining on the meter.

12. A construction in accordance with claim 11 wherein said drive means are utilized as said control means.

13. A construction in accordance with claim 11 wherein said positioning means comprises a cam, said indicator means including a cam follower for engagement with the surface of said cam.

* * * * *